US005497329A

United States Patent [19]

Tang

[11] Patent Number: 5,497,329

[45] Date of Patent: Mar. 5, 1996

[54] PREDICTION METHOD FOR ENGINE MASS AIR FLOW PER CYLINDER

[75] Inventor: Dah-Lain Tang, Canton, Mich.

[73] Assignee: General Motors Corporation, Detroit, Mich.

[21] Appl. No.: 948,568

[22] Filed: Sep. 23, 1992

[51] Int. Cl.[6] ..... F02B 3/04

[52] U.S. Cl. ..... 364/431.05; 73/118.2; 123/480; 123/488; 364/431.03

[58] Field of Search ..... 364/431.03, 431.05, 364/431.07, 558, 565, 571.02, 550, 431.01, 431.04, 510; 73/118.2; 123/73 SP, 480, 486, 488, 494

[56] References Cited

U.S. PATENT DOCUMENTS

| | | | |
|---|---|---|---|
| 4,424,568 | 1/1984 | Nishimura et al. | 364/431.07 |
| 4,630,206 | 12/1986 | Amamo et al. | 364/431.07 |
| 4,677,559 | 6/1987 | Van Brück | 364/431.05 |
| 4,706,634 | 11/1987 | Nishikawa et al. | 123/492 |
| 4,893,244 | 1/1990 | Tang et al. | 364/431.03 |
| 4,897,791 | 1/1990 | Sekozawa et al. | 364/431.05 |
| 4,951,209 | 8/1990 | Nagaishi et al. | 364/431.04 |
| 4,959,789 | 9/1990 | Nakamura | 364/431.05 |
| 4,987,888 | 1/1991 | Funabashi et al. | 123/488 |
| 5,255,209 | 10/1993 | Krebs | 364/558 |
| 5,270,935 | 12/1993 | Dudek et al. | 364/431.01 |
| 5,274,559 | 12/1993 | Takahashi et al. | 364/431.05 |
| 5,394,331 | 2/1995 | Dudek et al. | 364/431.05 |

*Primary Examiner*—Kevin J. Teska
*Assistant Examiner*—Russell W. Frejd
*Attorney, Agent, or Firm*—Michael J. Bridges

[57] ABSTRACT

A delta model is used to calculate a predicted manifold absolute pressure MAP for a future period and the air mass induced in each cylinder is calculated from such a predicted value and used to determine the correct amount of fuel to inject at that period. Several reference pulses generated for each crankshaft revolution establish one or more sets of equally spaced points at which measurements are made of the parameters MAP, throttle position, exhaust gas recirculation value and idle air control. A base value of MAP is calculated, trends of changes in the parameters are calculated for each set of points, and weighted values of the trends are summed with the base value to predict a value of MAP. Alternatively, mass air flow MAF is measured as well as the other parameters and mass air per cylinder MAC is calculated. Then a base value of MAC is calculated, trends of changes in the parameters are calculated for each set of points, and weighted values of the trends are summed with the base value to predict a value of mass air induced into a cylinder.

10 Claims, 5 Drawing Sheets

PREDICTION METHOD FOR ENGINE MASS AIR FLOW PER CYLINDER

FIELD OF THE INVENTION

This invention relates to a method of determining air flow for engine control and, particularly, for predicting air flow mass per cylinder for use in calculating fuel supply.

BACKGROUND OF THE INVENTION

In automotive engine control, the amount of fuel to be injected is often determined either by measuring the engine speed and the mass air flow (MAF) into the intake manifold, known as the air meter method, or by inferring the air flow from the measurement of engine speed and manifold-absolute pressure (MAP), known as the speed-density method. For both approaches, during engine transient operations, the differences between the measured MAF, throttle position, or MAP and their past values are used to adjust the amount of fuel for the air flow changes. As the exhaust emissions standards become more stringent, more effective ways of engine fuel control are needed.

In the speed-density approach, as shown in FIG. 1, the measured MAP signal is filtered before it is used for air flow estimation. The result is then used to compute the amount of fuel needed, taking into account the effects of exhaust gas recirculation (EGR). During transient operations, additional calculations are needed to compensate for the transient air and fuel dynamics. These transient control routines are commonly known as acceleration enrichment (AE) and deceleration enleanment (DE). In particular, measured changes in MAP and throttle position (TPS) are multiplied by AE/DE gains and added to the base fuel calculation. They are used to account for errors from both air estimation and fuel dynamics estimation. That is, the changes in throttle position (or MAP) are directly used to calculate the transient fuel requirement.

Due to the differences in the nature of the air and fuel dynamics, the prior acceleration enrichment and deceleration enleanment approaches do not completely reduce the transient air-fuel ratio errors. It is well recognized that the change in throttle position, together with other variables, such as idle air actuator (IAC) and EGR, causes change in MAP, which in turn changes the amount of air drawn into the cylinders. The fuel dynamics, on the other hand, is strongly influenced by the air flow and the surrounding temperature conditions. Lumping these two significantly different dynamics makes accurate control of air-fuel ratio extremely difficult.

SUMMARY OF THE INVENTION

The method of the present invention improves the performance of transient fuel control by separating the estimation of the air mass from the fuel dynamics, as shown in FIGS. 2 and 3. First the mass of air induced in a cylinder is predicted for a period in which fuel injection is about to occur and then the required fuel is determined. In FIG. 2, the mass of air per cylinder $m_{cp}$ is predicted by first predicting the MAP for the desired period and then applying the speed-density method which requires values for volumetric efficiency VE and manifold temperature T. Inputs used for the MAP prediction algorithm are MAP, TPS, IAC and EGR. Depending on the engine application, IAC and EGR may not be necessary, thereby simplifying the calculation.

In FIG. 3, the mass of air is predicted by first converting MAF to mass air calculated (MAC) as a function of engine speed and then doing a prediction of mass per cylinder $m_{cp}$. The simplest case is shown where only MAC and TPS inputs are required by the prediction algorithm, but in some cases, EGR and IAC inputs are needed, as in FIG. 2. It is also possible to use both MAP and MAF measurements; in that case MAP becomes another input to the prediction algorithm.

Whether MAP or $m_{cp}$ is predicted, the same type of algorithm is used. A similar approach is used in U.S. Pat. No. 4,893,244 to Tang et al. issued Jan. 9, 1990, and in U.S. patent application Ser. No. 07/733,565 filed on Jul. 22, 1991, entitled "Engine Speed Prediction Method for Engine Control", both of which are assigned to the assignee of this invention. In each case, the cylinder event is divided into several periods by reference pulses produced by an engine position sensor. In these prediction methods, the time interval between pulses is measured, and a trend of interval changes is determined and used to predict a future speed on the basis of a measured interval and the trend, the predicted speed being useful for spark timing or speed control purposes.

In the present invention, an engine position sensor is used in the same way to provide several reference pulses in each engine revolution. Generally, one set of reference pulses occurs at or near top and bottom dead centers of cylinder position, another set of pulses occurs at a predetermined angular spacing from the dead center positions, and still other sets may occur at other predetermined spacings from the dead center positions. At some or all of the reference pulses MAF or MAP is measured along with TPS and optionally other parameters such as EGR and IAC. Then, according to this invention, changes in the parameters between consecutive points in the same set are calculated to determine a trend of parameter change and each trend is weighted by a gain factor and added to a base value of MAF or MAP to obtain a predicted value. That value is then converted to a predicted induced air mass $m_{cp}$ for a cylinder about to receive an injection of fuel, and is useful for the calculation of the required amount of fuel.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 4:
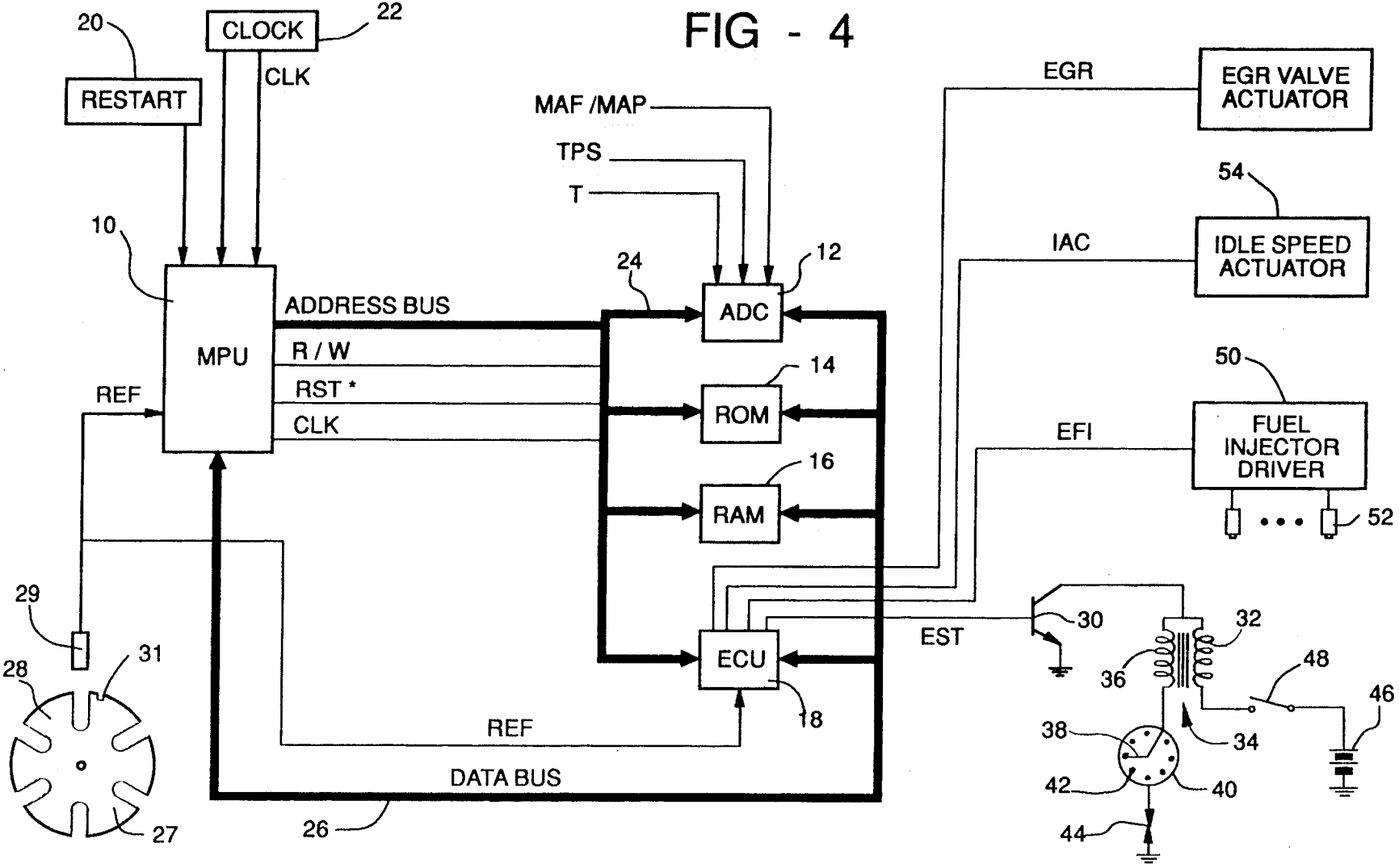
FIG. 4 is a schematic diagram of an electronic ignition and fuel control system for carrying out the method of the invention.

An apparatus for carrying out the calculations and implementing system control commands is shown in FIG. 4 and is similar to that of U.S. Pat. No. 4,893,244 to Tang et al. The electronic control system includes a microprocessing unit (MPU) 10, an analog-to-digital converter (ADC) 12, a read-only memory (ROM) 14, a random access memory (RAM) 16 and an engine control unit (ECU) 18. The MPU 10 may be a microprocessor model MC-6800 manufactured by Motorola Semiconductor Products, Inc. Phoenix, Ariz. The MPU 10 receives inputs from a restart circuit 20 and generates a restart signal RST* for initializing the remaining components of the system. The MPU 10 also provides an R/W signal to control the direction of data exchange and a clock Signal CLK to the rest of the system. The MPU 10 communicates with the rest of the system via a 16 bit address bus 24 and an 8-bit bi-directional data bus 26.

The ROM 14 contains the program steps for operating the MPU 10, the engine calibration parameters for determining the appropriate ignition dwell time and also contains ignition timing and fuel injection data in lookup tables which identify as a function of predicted engine speed and other engine parameters the desired spark angle relative to a reference pulse and the fuel pulse width. The MPU 10 may be programmed in a known manner to interpolate between the data at different entry points if desired.

Based on predicted engine speed, the spark angle is converted to time relative to the latest reference pulse producing the desired spark angle. The desired dwell time is added to the spark time to determine the start of dwell (SOD) time. In the same way, the start of injection (SOI) time is calculated from the fuel pulse width (FPW), the intake valve opening (IVO) time and the predicted speed. The control words specifying a desired SOD, spark time, SOI and FPW relative to engine position reference pulses are periodically transferred by the MPU 10 to the ECU 18 for generating electronic spark timing signals and fuel injection signals. The ECU 18 also receives the input reference pulses (REF) from a reference pulse generator 27 which comprises a slotted ferrous disc 28 driven by the engine crankshaft and a variable reluctance magnetic pickup 29.

In the illustrated example, the slots produce six pulses per crankshaft revolution or three pulses per cylinder event for a four cylinder engine. One extra slot 31 produces a synchronizing signal used in cylinder identification. The reference pulses are also directed to the MPU 10 to provide hardware interrupts for synchronizing the spark and fuel timing calculations to the engine position.

The EST output signal of the ECU 18 controls the start of dwell and the spark timing and is coupled to a switching transistor 30 connected with the primary winding 32 of an ignition coil 34. The secondary winding 36 of the ignition coil 34 is connected to the rotor contact 38 of a distributor, generally designated 40, which sequentially connects contacts 42 on the distributor cap to respective spark plugs, one of which is illustrated by the reference numeral 44. Of course the distributor function can be accomplished by an electronic circuit, if desired.

The primary winding 32 is connected to the positive side of the vehicle battery 46 through an ignition switch 48. An EFI output signal of the ECU 18 is coupled to a fuel injector driver 50 which supplies actuating pulses to fuel injectors 52. To control idle speed, a signal IAC is calculated by the ECU with the predicted engine speed in mind, and is coupled to an idle speed actuator 54 to provide an appropriate amount of air to the engine. To establish the position of an EGR valve actuator 56, the ECU estimates the EGR concentration and the air flow into individual cylinders for good air-fuel ratio control and generates the EGR signal accordingly.

The inputs to the ADC 12 comprise intake manifold temperature T, throttle position TPS manifold-absolute pressure MAP and/or a mass airflow meter output MAF. The timing of the reference pulses is used to determine when to measure those parameters. The engine control micro-computer 18 will use them to predict the total amount of air $m_{cp}$ that will flow into each cylinder and then calculate the amount of fuel to be injected to the cylinders whose intake valve just opened or is about to open.

Figure 5:
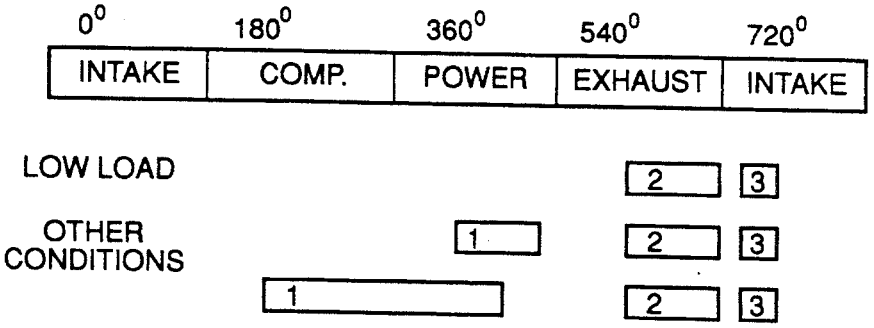
FIG. 5 is a diagram showing periods of fuel injection relative to cylinder events for various operating conditions.

To achieve high accuracy in engine fuel control, the time to execute the prediction methods has to be coordinated with the fuel injection scheme. At the selected reference pulses, the TPS, MAP and RPM are closely monitored to determine whether fuel injection should be initiated. As shown in FIG. 5, there are two main fuel injection events (1 and 2) in one combustion cycle. A third one (3) is used only for a sudden heavy engine acceleration.

The first fuel injection pulse takes place long before the intake valve is open to allow as much residence time as possible for fuel to vaporize. The amount of fuel to be injected in the first injection is based on the engine speed, fuel requirement, the changes in TPS, and the injector dynamic limitation. When a relatively small fuel amount is needed, such as at low load, the first injection is not necessary.

The second injection, taking place just before the intake valve is open, is the most critical one for high accuracy. It is based on the most recent calculated fuel requirement, allowing for the fuel already injected in the first injection. When necessary, such as for the case where the throttle suddenly opens after the second fuel pulse-width is calculated, a third injection pulse can be deployed to provide additional fuel to minimize the air-fuel ratio errors.

Air Mass Prediction Using MAP

For simplicity, the method using MAP will be taken up first and then the similar method using MAF will be discussed.

Figure 6:
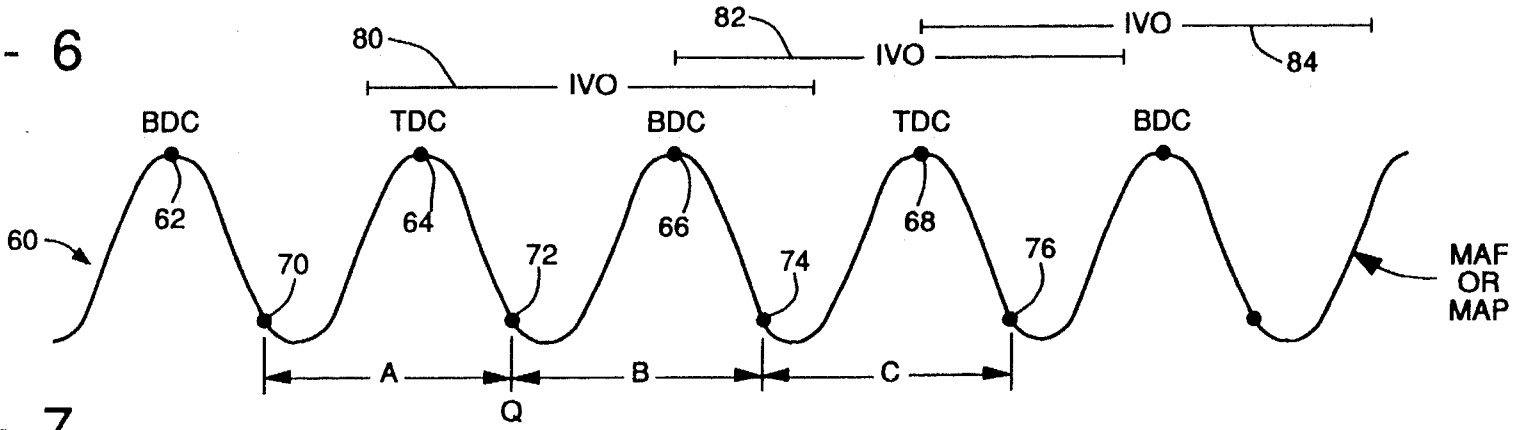
FIGS. 6, 7 and 8 are graphs of manifold pressure or mass air flow showing the positions of references pulses used in the method according to the invention.

In this description, an illustration is used for a four cylinder engine having only four reference pulses per crankshaft revolution. FIG. 6 shows a MAP waveform 60 which generally resembles a sine wave with peaks occurring at both top dead centers (TDC) and bottom dead centers (BDC) of cylinder position. Dots represent reference pulses 62, 64, 66 and 68 marking one set of points at or near the dead center positions while pulses 70, 72, 74 and 76 make up another set of points which are equally spaced from dead center positions, say 60°, after dead center. Thus the four pulses per revolution are not necessarily equally spaced but the pulses or points within each set are equally spaced by 180° of crankshaft rotation for the four cylinder engine application. In the case of a six cylinder engine, the pulses will be spaced by 120°.

A measurement of MAP is recorded at each reference pulse. Each MAP measurement is filtered by averaging with the previous two measurements to obtain a MAP value for each point. For calculations made at Q, corresponding to point 72, the MAP value at point 72 is used as a base value $MAP_{base}$ and then a MAP trend is calculated to allow prediction of MAP at a point 180° ahead, which is point 74.

The trend is measured according to changes in MAP, TPS and often other parameters which take place during the last 180° period which is marked as period A.

Thus, each of the parameters is measured at each point in the set of points 70, 72, etc. The primary changes are in parameters MAP and TPS and are measured by subtracting their values at point 70 from their respective values at point 72 to yield Delta-$MAP_A$ and Delta-$TPS_A$. Using this amount of information the predicted $MAP_p$ equation is:

$$MAP_p = MAP_{base} + G1(\text{Delta-}MAP_A) + G2(\text{Delta-}TPS_A) \quad (1)$$

where G1 and G2 are empirically determined prediction gains.

Additional values for measuring trend are IAC, EGR and RPM. Their changes over period A are calculated in the same way to obtain Delta-$IAC_A$, Delta-$EGR_A$ and Delta-$RPM_A$. The predicted $MAP_p$ at the target point 74 is then:

$$MAP_p = MAP_{base} + G1(\text{Delta-}MAP_A) + G2(\text{Delta-}TPS_A) + G3(\text{Delta-}IAC_A) + G4(\text{Delta-}EGR_A) + G5(\text{Delta-}RPM_A) \quad (2)$$

The lines 80, 82 and 84 at the top of FIG. 6 and denoted IVO indicate the span of intake valve opening for successive cylinders. Since the line 80 indicates that at the calculation time Q, a valve is already open for one cylinder, the predicted $MAP_p$ is used to calculate the amount of the third injection pulse, if any, for that cylinder. At the same time, the $MAP_p$ is used to calculate the second injection pulse for the cylinders corresponding to valve openings 82 and 84. When the time reaches point 74, the calculation is repeated using the measurements for the period B to predict MAP for point 76.

Figure 7:
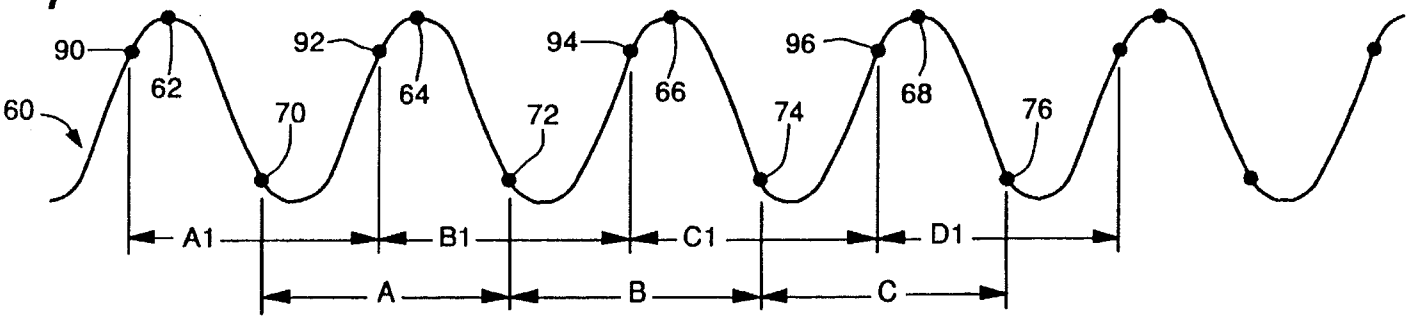

FIG. 7 shows the same MAP curve 60 but with six reference pulses per crankshaft revolution. This allows another level of prediction terms to be included in the calculation of future MAP. The additional reference pulses provide another set of points 90–96 positioned, for example, 30° before each dead center. These points define new periods A1, B1, C1, etc. which occur 90° ahead of corresponding periods A, B, C etc.

As in FIG. 6, the MAP values are the average of the last three MAP measurements, and a recent MAP value is used as the base MAP value. At point 72, the MAP trend is calculated from the changes of parameters over period A as well as the changes of parameters over period A1. Even the periods between dead centers can be used to avail trend information. Thus, when the measurements from more points are used, the equation for $MAP_p$ has additional weighted trend terms for greater prediction accuracy. If the MAP value at point 72 is chosen to be the base MAP value, the prediction target will be point 74, which is 180° beyond the time of calculation. However if the MAP value at point 92 is chosen as the base MAP value, the prediction target will be point 94 which is 90° beyond the time of calculation. Similarly, the base value can be that at point 64 and the prediction target will then be point 66, which is 120° beyond the calculation time at point 72.

Figure 8:
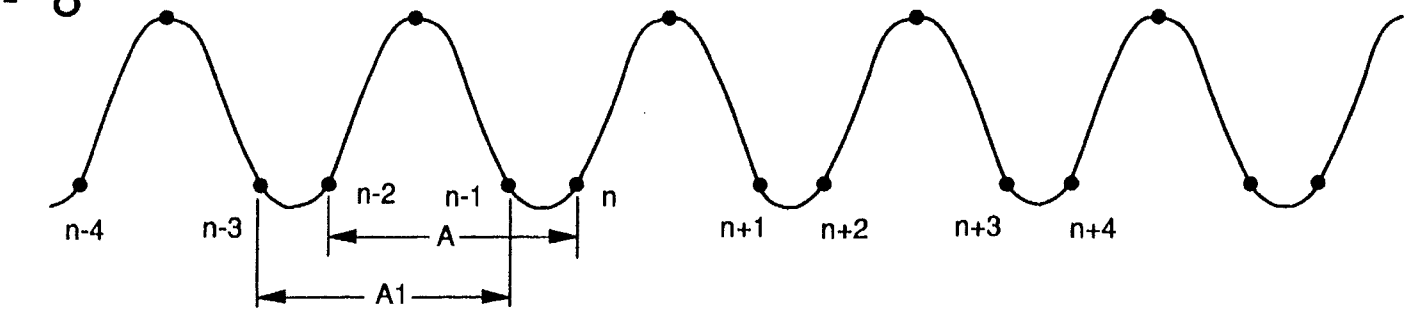

Still another example of six reference points per revolution for a four cylinder engine is shown in FIG. 8. There, the nomenclature is generalized with the points identified as n, n+1, n−1, etc., omitting the values at dead center points for trend calculations but using them if desired for base MAP values. The prediction equation then becomes $$MAP_p(n+q) = MAP(n) + \quad (3)$$

-continued $$SUM\{a_i(MAP(n-i) - MAP(n-i-p))\} + SUM\{b_j(TPS(n-j) - TPS(n-j-p))\} + SUM\{c_s(EGR(n-s) - EGR(n-s-p))\} + SUM\{d_t(IAC(n-t) - IAC(n-t-p))\}$$

where n is the cylinder firing event at the time prediction is executed; p is the number of sampling points in one firing event and q is the prediction horizon; $a_i$, $b_j$, $c_s$ and $d_t$ are prediction gains and i, j, s and t are numbers from zero up to the terms selected according to the system dynamics. The prediction gains themselves can be functions of the engine operating conditions and are determined empirically for each type of engine. An RPM term may also be added to the prediction equation.

Figure 9:
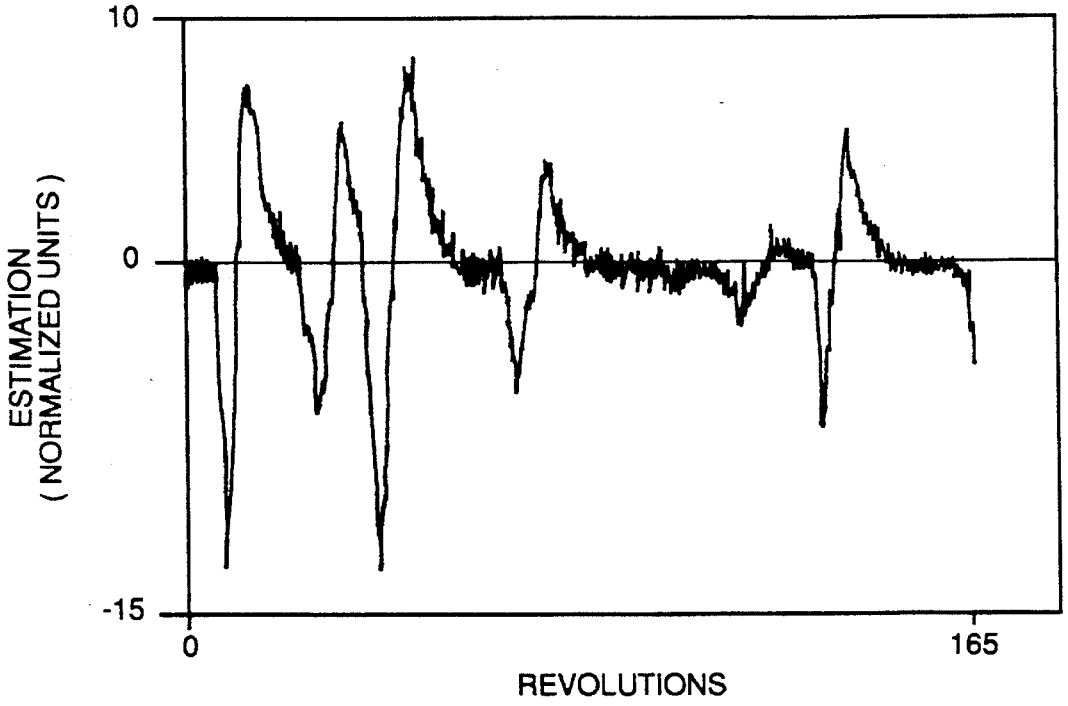
FIGS. 9 and 10 are graphs showing air mass estimation error without and with prediction, respectively.
Figure 10:
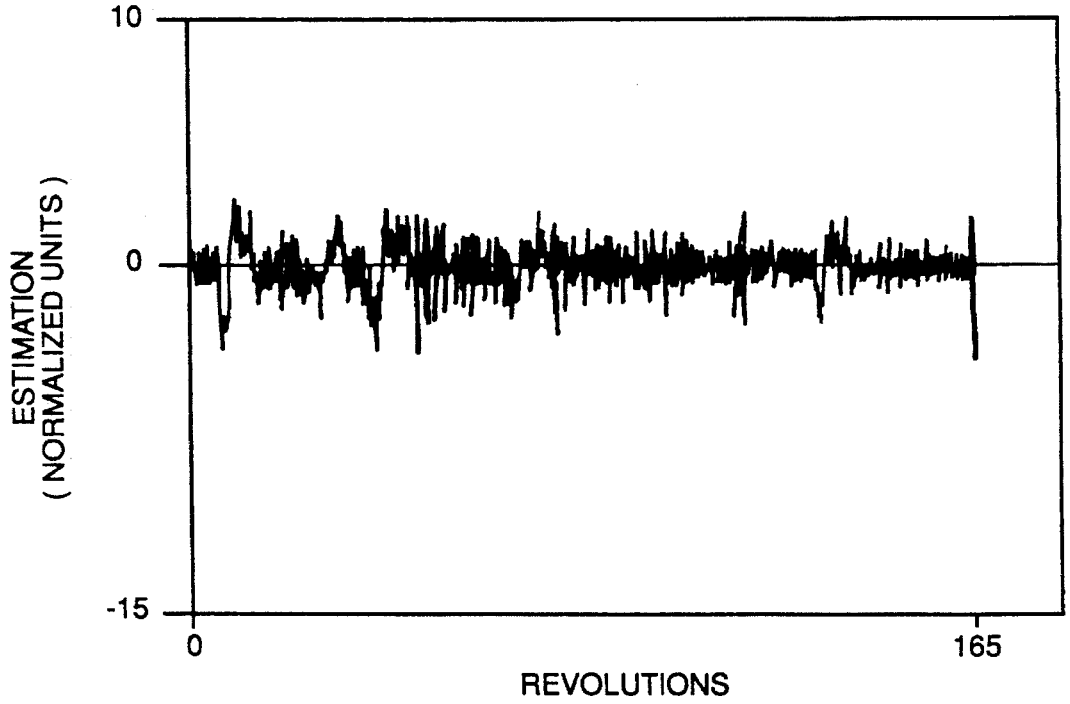

The number of terms used in the above equation should be determined by the system dynamics. That is, the influence of TPS, EGR, IAC and MAP itself on the future MAP. Some engines do not employ EGR and thus the EGR term does not apply; other engines restrain the rate of change of EGR so that it is not an important transient factor and the EGR term can be omitted. Due to the throughput limitation of the micro-controller, it may be desirable to reduce the number of terms. In one engine good results were obtained by reducing the trend terms to two, using only gains $a_0$ and $b_0$ to result in equation (1) above. For that engine operating over a test maneuver lasting for about 165 engine revolutions, FIG. 9 shows the MAP estimation error when no prediction algorithm is used and FIG. 10 shows the estimation errors when the prediction algorithm is used.

The prediction method is simple and requires little computation. The "delta" model is selected for prediction because this model eliminates steady state errors by providing integrator effects inherently. Thus, it does not need additional mechanisms to compensate for the steady state bias caused by changes in engine operation and vehicle loads. It also has the advantage of maintaining steady state accuracy when the ambient pressure varies as the vehicle is driven through different altitudes.

Given the predicted MAP, the predicted mass of air induced into each cylinder $m_{cp}$ is determined from well known speed density calculations. In general, $$m_{cp} = K * MAP_p * VE/T \quad (4)$$

where K is a constant, VE is volumetric efficiency, and T is manifold temperature. The volumetric efficiency VE is a variable empirically determined as a function of RPM and $MAP_p$. For a given MAP target point, calibration to determine VE begins with steady state engine operation. VE tables are constructed to match the measured air flow into the cylinders for each of several different engine speeds. Then the parameters used in MAP prediction are obtained under transient operating conditions and additional VE tables can be constructed for those other engine transient conditions such as EGR and IAC, as needed.

The desired amount of fuel for each cylinder event is calculated based on the estimated induced air mass per cylinder and the desired air-fuel ratio. The fuel injector parameters are also used to determine the injector voltage pulse-width. Finally, the crankshaft location to start the fuel delivery is selected and the corresponding time to open the fuel injector is computed.

Figure 11:
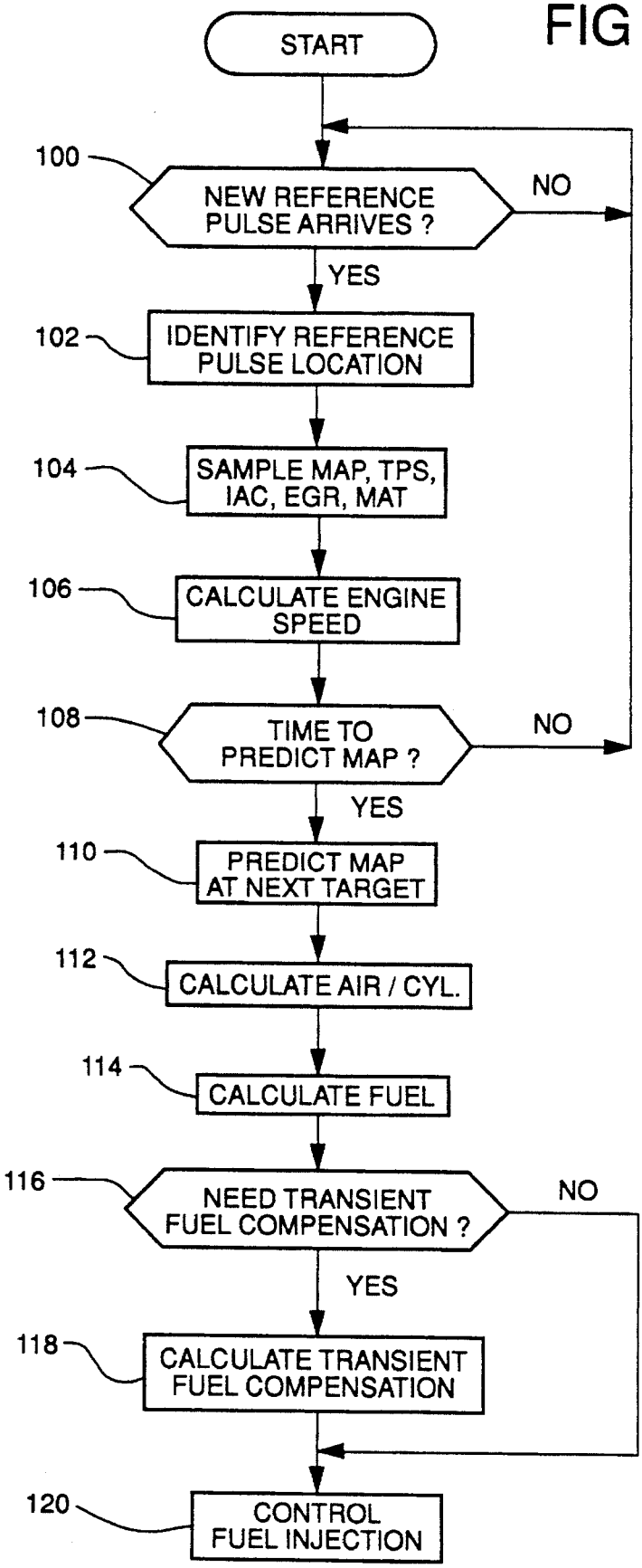
FIG. 11 is a flow chart of the implementation of the prediction algorithm according to the invention.

A flow chart in FIG. 11 illustrates the implementation of the prediction method by the engine controller. In the description of the flow chart, numerals in angle brackets <nn> are used to refer to functions in the blocks bearing the corresponding reference numeral. When a new reference pulse arrives <100>, its crank angle location is identified <102>, and then MAP, TPS, IAC, and EGR are measured <104>. Engine speed is calculated <106> preferably using the engine speed prediction method disclosed in the above-mentioned patent application Ser. No. 733,565. If it is time to predict MAP <108>, the computation of $MAP_p$ is performed in accord with equation (3) to determine MAP at the next target point <110>. With this information the induced air mass per cylinder is calculated <112>and the fuel amount is also calculated <114>. If transient fuel compensation (a third injection pulse) is needed <116> that value is calculated <118>. As is fully set out in the above-mentioned application Ser. No. 733,565, the fuel injector is controlled to inject the correct fuel amount to the cylinder <120>.

Air Mass Prediction Using MAF

Figure 1:
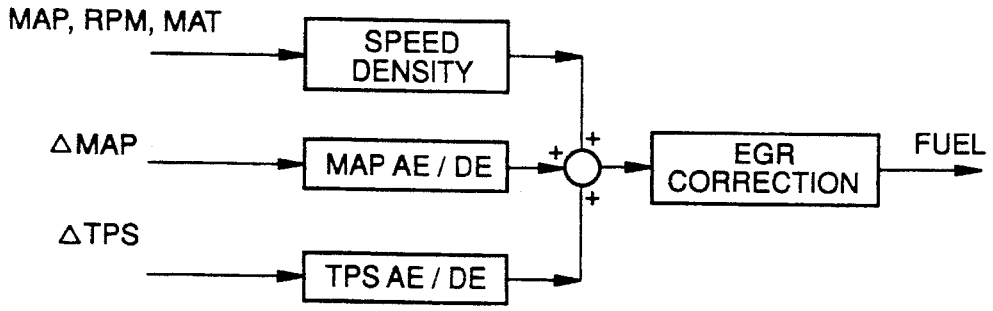
FIG - 1 ( PRIOR ART )
FIG. 1 is a block diagram of a prior art fuel calculation algorithm.
Figure 2:
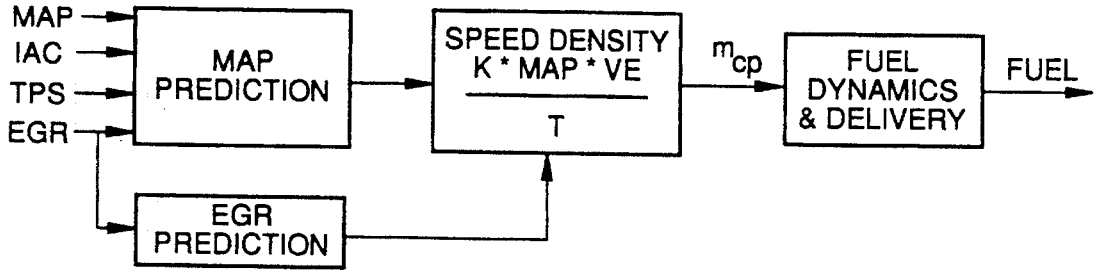
FIG. 2 is a block diagram of a fuel calculation method using a predictive MAP algorithm to determine the air mass being induced, according to the invention.
Figure 3:
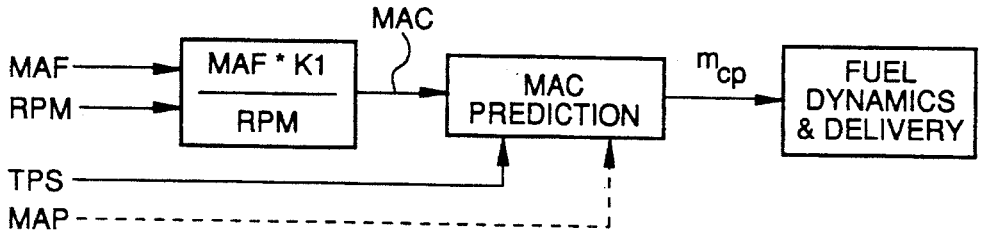
FIG. 3 is a block diagram of a fuel calculation method using a predictive MAF algorithm to determine the air mass being induced, according to the invention.

To apply the air mass prediction method to systems using a mass air flow meter, the mass air flow MAC is calculated as MAC=Kl*MAF/RPM, where Kl is a constant, as indicated in FIG. 3. Then MAC is substituted for MAP in the above equation (3) to obtain the predicted air mass per cylinder mcp. Restated in MAC form, equation (3) becomes $$m_{cp}(nq) = MAC(n) + \quad (5)$$

$$\begin{aligned} &SUM\{a_i(MAC(n-i) - MAC(n-i-p))\} + \\ &SUM\{b_j(TPS(n-j) - TPS(n-j-p))\} + \\ &SUM\{c_s(EGR(n-s) - EGR(n-s-p))\} + \\ &SUM\{d_t(IAC(n-t) - IAC(n-t-p))\} \end{aligned}$$

Thus, the predicted $m_{cp}$ is determined by selecting a recent value of MAC for a base and adding the trend which is calculated on the basis of the change of the several parameters over one or more periods, as expressed in equation (5). The primary difference in implementation is that the conversion to per cylinder value is performed first and the predicted value is $m_{cp}$ instead of $MAP_p$. In equation (5), a previously predicted value $m_{cp}(n)$ can be used as the base instead of MAC(n).

As suggested by FIG. 3, one embodiment of the invention utilizes both MAP and MAF measurements for the prediction of the mass air flow per cylinder $m_{cp}$. In that event, the equation (5) is further modified by including MAP terms in the trend calculation so the change in MAP per interval affects the trend.

It will thus be seen that for either the speed-density approach or the MAF meter approach to measuring the air mass per cylinder, the air mass value can be accurately predicted during transient operating conditions in time to calculate and implement precise fuel injection amounts for the target prediction time.

The embodiments of the invention in which an exclusive property or privilege is claimed are defined as follows:

1. In an engine fuel control system having apparatus for measuring manifold absolute pressure (MAP) and a throttle position signal (TPS) at reference times during each engine revolution, a method of controlling engine fueling by predicting the air flow into each cylinder comprising the steps of:

determining values of MAP and TPS at each point of at least one set of points uniformly spaced from each dead center;

calculating trends of MAP values and TPS values from the values determined at consecutive points in the set;

determining a base MAP value from at least the most recent MAP value;

predicting a future MAP value from the base MAP value and the calculated trends;

predicting a mass of air into a cylinder from the predicted MAP value by determining volumetric efficiency, and manifold temperature, and determining the mass of air as a function of the predicted MAP value, the volumetric efficiency, and the manifold temperature;

calculating a desired amount of fuel to be delivered to the cylinder as a predicted function of the determine mass of air; and controlling a fuel injector to deliver the desired amount of fuel to the cylinder.

2. The invention as defined in claim 1 wherein the system includes apparatus for producing an exhaust gas recirculation valve signal (EGR) and an idle air control signal (IAC), and wherein the method includes the steps of:

detecting values of EGR and IAC at each of the points; and calculating the trends of EGR and IAC from the their respective values at the most recent points;

wherein the step of predicting a future MAP value includes using the trends of EGR and IAC.

3. In an engine fuel control system having apparatus for measuring values of manifold absolute pressure (MAP) and a throttle position signal (TPS) and for detecting values of an exhaust gas recirculation valve signal (EGR) and an idle air control signal (IAC) at reference times during each engine revolution, a method of controlling engine fueling by predicting air flow into an engine cylinder comprising the steps of:

measuring MAP, TPS, EGR and IAC values at each point of at least one set of points uniformly spaced relative to each dead center;

calculating trends of each of the measured values from a difference of respective values at successive points;

determining a base MAP value;

predicting a future MAP value from the base MAP value and the calculated trends by multiplying each calculated trend by a respective gain to form a series of products and adding such products to the base MAP value;

predicting air flow into said cylinder from the predicted MAP value;

calculating a desired amount of fuel to be delivered to the engine cylinder as a predetermined function of the predicted air flow; and controlling a fuel injector to deliver the desired amount of fuel to the engine cylinder.

4. The invention as defined in claim 3 wherein the step of determining a base MAP value includes measuring MAP values near each cylinder top dead center and bottom dead center.

5. The invention as defined in claim 3 wherein the set of points includes a first set of points having a first uniform spacing relative to dead center positions and a second set of points having a second uniform spacing relative to dead center positions; and the step of calculating the trends includes determining a change in each value between successive points in each of said first and second sets.

6. In an engine fuel control system having apparatus for measuring mass air flow (MAF) throttle position signal (TPS), exhaust gas recirculation valve signal (EGR) and an idle air control signal (IAC), a method of controlling engine fueling by predicting the air flow into each cylinder comprising the steps of:

measuring MAF at each point of at least one set of points uniformly spaced from each dead center;

detecting values of EGR and IAC at each of the points;

calculating mass air flow per cylinder (MAC) at each point from MAF and engine speed;

measuring TPS at each of said points;

calculating trends of MAC values and TPS values from the measurements at consecutive recent points;

calculating trends of EGR and IAC from their respective values at the most recent points;

determining a base average MAC value from at least a most recent dead center MAF measurement;

predicting air flow into each cylinder from the base MAC value and the calculated trends;

calculating a desired amount of fuel to be delivered to each cylinder as a predetermined function of the predicted air flow into the respective cylinder; and controlling at least one fuel injector to deliver the desired amount of fuel to each respective cylinder.

7. In an engine fuel control system having apparatus for measuring values of mass air flow (MAF), absolute manifold pressure (MAP) and a throttle position signal (TPS) and for detecting values of engine speed, an exhaust gas recirculation valve signal (EGR) and an idle air control signal (IAC) at reference times during each engine revolution, the method of controlling engine fueling by predicting the air flow into an engine cylinder comprising the steps of:

measuring MAF, MAP, TPS, EGR and IAC values at each point of at least one set of points uniformly spaced relative to each dead center;

calculating air mass flow per cylinder MAC from MAF and engine speed at each point;

calculating trends of each of the values MAC, MAP, TPS, EGR, and IAC from a difference of respective values at successive points;

determining a base value of air mass per cylinder;

predicting air mass into said cylinder from the base value and the calculated trends by multiplying each calculated trend by a respective gain to form a series of products and adding said products to the base value;

calculating a desired amount of fuel to be delivered to said cylinder as a predetermined function of the predicted air mass into said cylinder; and controlling a fuel injector to deliver the desired amount of fuel to said cylinder.

8. The invention as defined in claim 7 wherein the step of determining a base value includes measuring MAF values at each cylinder top dead center and bottom dead center.

9. The invention as defined in claim 7 wherein the base value comprises a previously predicted value of air mass into a cylinder.

10. The invention as defined in claim 7 wherein the set of points includes a first set of points having a first uniform spacing relative to dead center positions and a second set of points having a second uniform spacing relative to dead center positions; and the step of calculating the trends includes determining the change in each value between successive points in each of said first and second sets.

* * * * *